US010017993B2

(12) United States Patent
Hu et al.

(10) Patent No.: US 10,017,993 B2
(45) Date of Patent: Jul. 10, 2018

(54) EXPLORATION DRILLING SYSTEM AND METHOD FOR SUPPLYING POWER THERETO

(71) Applicant: General Electric Company, Schenectady, NY (US)

(72) Inventors: Lishun Hu, Shanghai (CN); Yu Zhou, Beijing (CN); Wenqiang Yang, Shanghai (CN)

(73) Assignee: General Electric Company, Schenectady, NY (US)

( * ) Notice: Subject to any disclaimer, the term of this patent is extended or adjusted under 35 U.S.C. 154(b) by 336 days.

(21) Appl. No.: 14/743,444

(22) Filed: Jun. 18, 2015

(65) Prior Publication Data

US 2015/0369017 A1 Dec. 24, 2015

(30) Foreign Application Priority Data

Jun. 18, 2014 (CN) ..... 2014 1 0272958

(51) Int. Cl.
*E21B 4/04* (2006.01)
*E21B 3/02* (2006.01)

(52) U.S. Cl.
CPC . *E21B 4/04* (2013.01); *E21B 3/02* (2013.01)

(58) Field of Classification Search
CPC ..... E21B 4/04; E21B 3/02; E21B 41/0085; E21B 7/00
See application file for complete search history.

(56) References Cited

U.S. PATENT DOCUMENTS

| | | | | |
|---|---|---|---|---|
| 7,841,394 | B2 | 11/2010 | McNeel et al. | |
| 8,360,152 | B2 | 1/2013 | Defosse et al. | |
| 8,936,073 | B1 * | 1/2015 | Phillips | E21B 15/00 166/75.11 |
| 8,955,657 | B2 | 2/2015 | Osara et al. | |
| 2004/0100256 | A1 | 5/2004 | Fickert et al. | |
| 2008/0203734 | A1 * | 8/2008 | Grimes | E21B 3/02 290/40 R |
| 2009/0195074 | A1 * | 8/2009 | Buiel | H02J 3/28 307/48 |

(Continued)

FOREIGN PATENT DOCUMENTS

| | | | |
|---|---|---|---|
| CN | 102712260 | A | 10/2012 |
| CN | 203188906 | U | 9/2013 |

(Continued)

OTHER PUBLICATIONS

Anonymous, "Hybrid Genset System for Impulsive Power Demand Plant", IP.com, Disclosure No. IPCOM000234865D, Feb. 11, 2014.

(Continued)

*Primary Examiner* — Jennifer H Gay
(74) *Attorney, Agent, or Firm* — GE Global Patent Operation; Rita D. Vacca

(57) ABSTRACT

A drilling system, comprising: a plurality of drilling drive systems; a fracturing drive system; a centralized power supply system electrically coupled to said drilling drive systems and said fracturing drive system to supply power thereto; and a plurality of distributed power supply systems electrically coupled to said drilling drive systems to supply additional power thereto during peak loading of a respective one of the plurality of drilling drive systems.

10 Claims, 4 Drawing Sheets

(56) References Cited

U.S. PATENT DOCUMENTS

2009/0312885 A1* 12/2009 Buiel ..... H02J 3/32 700/297
2010/0038907 A1* 2/2010 Hunt ..... E21B 41/0085 290/7
2011/0148209 A1* 6/2011 Williams ..... H02J 3/32 307/75
2012/0223524 A1* 9/2012 Williams ..... H02J 3/005 290/50
2012/0292992 A1* 11/2012 Williams ..... F02D 19/10 307/23
2012/0317973 A1* 12/2012 Gulen ..... F01K 23/101 60/597
2013/0271083 A1* 10/2013 Williams ..... H02J 3/28 320/128
2013/0306322 A1* 11/2013 Sanborn ..... E21B 43/26 166/308.1
2014/0096974 A1* 4/2014 Coli ..... E21B 43/26 166/358
2014/0138079 A1* 5/2014 Broussard ..... E21B 43/26 166/66.4
2014/0268100 A1* 9/2014 Paul ..... G01L 311/16 356/32
2015/0222121 A1* 8/2015 Kuttel ..... H02J 3/00 322/8
2015/0369017 A1* 12/2015 Hu ..... E21B 4/04 166/244.1
2016/0032703 A1* 2/2016 Broussard ..... E21B 43/267 166/250.01
2016/0177675 A1* 6/2016 Morris ..... F01D 15/00 166/308.1

FOREIGN PATENT DOCUMENTS

WO 2012122636 A1 9/2012
WO 2012165954 A2 12/2012

OTHER PUBLICATIONS

Machine Translation and First Office Action and Search issued in connection with corresponding CN Application No. 201410272958.6 dated May 31, 2017.

* cited by examiner

EXPLORATION DRILLING SYSTEM AND METHOD FOR SUPPLYING POWER THERETO

BACKGROUND

Embodiments of the present invention relate to an exploration drilling system and method for supplying power thereto, more specifically to an exploration drilling system for drilling wells and fracturing and method for supplying power thereto.

BRIEF DESCRIPTION

Large amounts of electrical energy are required for drilling wells and fracturing during the extraction of oil or coal-bed methane, but drilling wells and fracturing require different intensities of electrical energy supplied over different durations of time. In general, the continuous supply of electrical energy at low power (about 4 MW) for 3-6 months is needed to drill a well and the load frequently peaks during the drilling of wells. Electrical energy generally needs to be supplied at high power (about 30 MW) at a stable rate for 1-2 weeks for fracturing in a single well.

In conventional exploration drilling systems, a plurality of independent power supply devices is used to separately supply power to the drilling drive system and fracturing drive system, so as to utilize different power supply devices for power supply during drilling and fracturing, to satisfy the different power requirements of drilling wells and fracturing. Consequently only some of the power supply devices operate during drilling wells and fracturing, while the other devices are idle. This requires the purchase of a large number of power supply devices although the utilization rate of the power supply devices is not high and extraction costs are high.

Therefore, it is necessary to provide an exploration drilling system and method of supplying power thereto to solve at least one of the aforementioned technical problems.

SUMMARY OF THE INVENTION

One aspect of the invention is to provide an exploration drilling system comprising: a plurality of drilling drive systems; a fracturing drive system; a centralized power supply system electrically coupled to the plurality of drilling drive systems and fracturing drive system to supply power thereto; and a plurality of distributed power supply systems electrically coupled to said drilling drive systems to provide additional power thereto during peak loading of a respective one of the plurality of drilling drive systems.

Another aspect of the invention is to provide a method of supplying power comprising: supplying power from a centralized power supply system to a plurality of drilling drive systems to drill wells; supplying additional power from a plurality of distributed power supply systems to the plurality of drilling drive systems during peak loading of a respective one of the plurality of drilling drive systems; and supplying power from the centralized power supply system to a fracturing drive system to fracture a formation at the wells.

DRAWINGS

The present invention may be better understood through a description of embodiments of this invention combined with the accompanying drawings, which are as follows.

DETAILED DESCRIPTION

Unless otherwise defined, the meaning of technical terms or scientific terms used herein should be taken as the ordinary meaning understood by a person having ordinary skill in the technical field of the present invention. "Comprises", "comprising" or other similar words applied in the specification or claims of the present patent application imply that one or more elements or objects appearing before "comprises" or "comprising" covers the enumerated elements or objects and those equivalent elements thereof appearing after "comprises" or "comprising"; however, other elements or objects are not excluded. The meanings of "coupled" or "interconnected" and other similar terms are not limited to direct connections, but also cover indirect connections.

Figure 1:
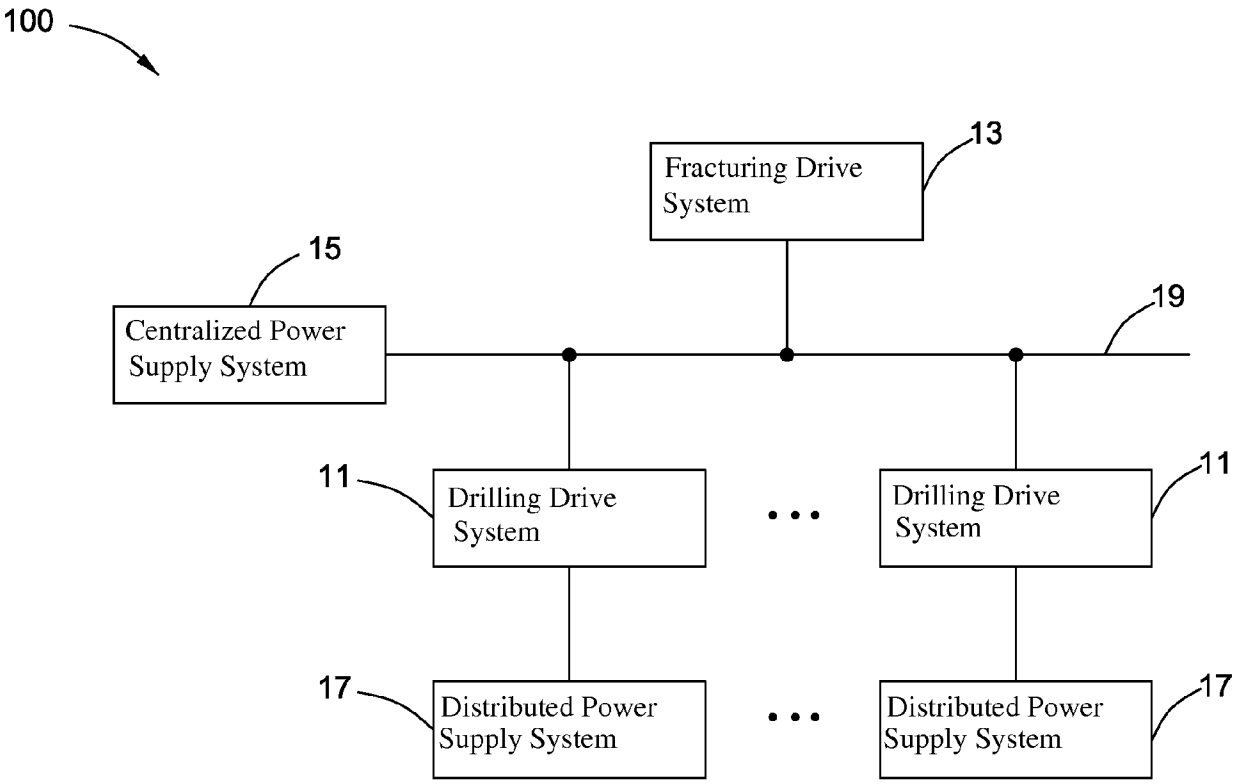
FIG. 1 is a schematic diagram of one embodiment of the exploration drilling system of the present invention.

FIG. 1 is a schematic diagram of exploration drilling system 100 of one embodiment. Exploration drilling system 100 is used for drilling during oil or coal-bed methane extraction and fracturing in the drilled well. System 100 comprises a plurality of drilling drive systems 11, a fracturing drive system 13, a centralized power supply system 15 and a plurality of distributed power supply systems 17. Drilling drive systems 11 (such as drills) are employed to drill wells. Generally speaking, said multiple drilling drive systems 11 can drill multiple wells simultaneously. Fracturing drive system 13 is for fracturing in the drilled well. Centralized power supply system 15 is electrically coupled to drilling drive systems 11 and fracturing drive system 13 to supply power to drilling drive systems 11 and fracturing drive system 13. Centralized power supply system 15 supplies stable high power (about 20-30 MW) electrical energy. Centralized power supply system 15 can supply power to drilling drive systems 11 and fracturing drive system 13 via transmission bus or grid 19 etc. The grid can connect other devices requiring power or control devices distributing power. Fracturing drive system 13 requires 15-20 MW of power to fracture in a well. Centralized power supply system 15 provides stable high power electrical energy to fracturing drive system 13.

A plurality of distributed power supply systems 17 are electrically coupled to a plurality of drilling drive systems 11 to provide additional power thereto when a respective one of the plurality of drilling drive systems 11 is at peak load. In this embodiment, each distributed power supply system 17 is connected to one drilling drive system 11. Centralized power supply system 15 provides basic power to multiple drilling drive systems 11 to drill wells. Centralized power supply system 15 supplies about 3-4 MW of power to each drilling drive system 11. When one or more drilling drive systems 11 is at peak load due to factors such as geology, one or more corresponding distributed power supply systems 17 provide additional power to drilling drive systems 11. In other words, centralized power supply system 15, together with drilling drive systems 11, supply power to drilling drive systems 11 at such time to meet the requirements due to the sudden load increase. The electrical power provided from an individual distributed power supply system 17 is less than the electrical power provided from the centralized power supply system 15. An individual distributed power supply system 17 supplies about 1 MW of electrical power. Drilling and fracturing can be separately powered by centralized power supply system 15, thus simplifying drilling system 100, reducing the number of power supply devices and increasing the utilization rate of the power supply system.

In an embodiment, centralized power supply system 15 comprises a plurality of diesel engines, e.g., 10 diesel engines. The plurality of diesel engines supplies stable power to both fracturing drive system 13 and drilling drive systems 11. Distributed power supply system 17 comprises a gas turbine generator. The gas turbine generator can be arranged at the mouth of a well to provide additional power to bear the increased load when one or more of drilling drive systems 15 is at peak load. In this embodiment, each distributed power supply system 17 comprises a gas turbine generator. At present, a large number of diesel engines are employed at old and mature oil or coal-bed methane fields. In this embodiment, said diesel engines can be combined to form centralized power supply system 15, thus improving the utilization rate of the diesel engines, optimizing power supply system of exploration drilling system 100 and putting existing resources to good use without increasing costs.

In another embodiment, centralized power supply system 15 comprises an aero-derivative turbine. One aero-derivative turbine can supply 20-30 MW of power. One aero-derivative turbine can be employed in centralized power supply system 15 to supply power to fracturing drive system 13 and drilling drive systems H. Thus centralized power supply system 15 occupies a small area and is convenient to maintain. Since natural gas is employed as the fuel of the aero-derivative turbine, fuel and operating costs are low, in yet another embodiment, centralized power supply system 15 comprises wind power generation equipment or other power generation equipment. If the area of oil or coal-bed methane extraction is located near a wind farm, it will be easier to employ power generated by wind power generation equipment.

Figure 2:
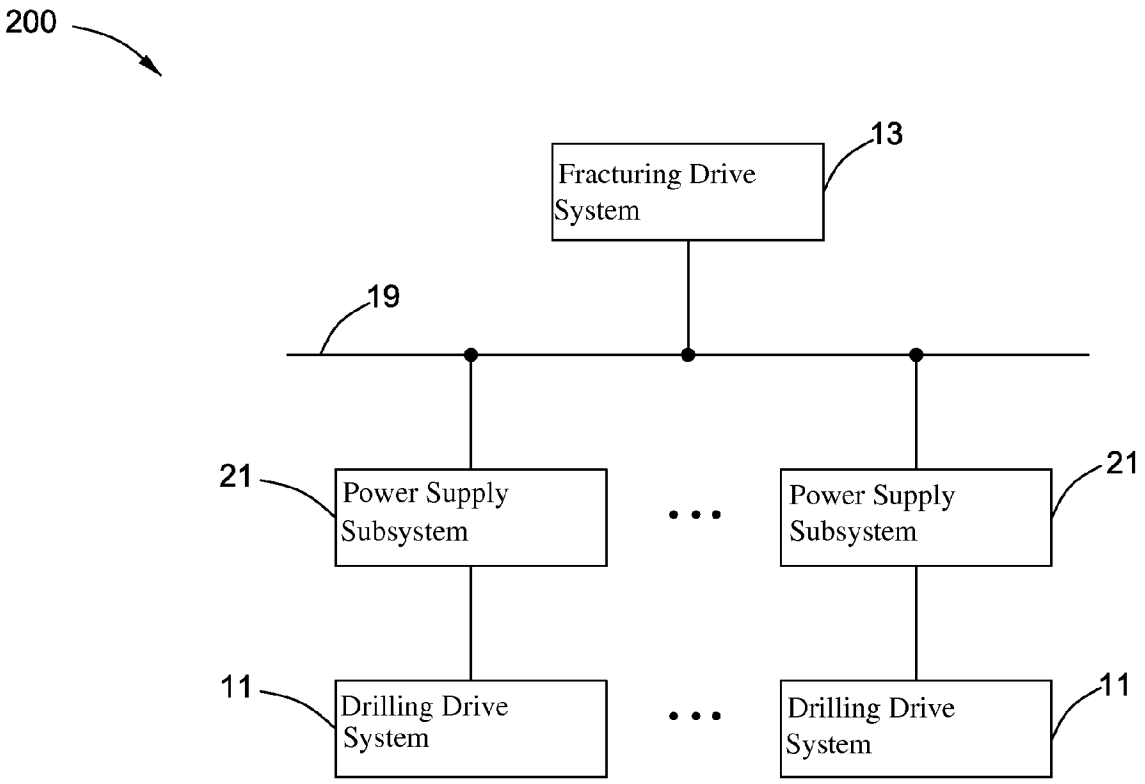
FIG. 2 is a schematic diagram of another embodiment of the exploration drilling system of the present invention.

FIG. 2 is a schematic diagram of drilling system 200 of another embodiment. Said drilling system 200 comprises a plurality of power supply subsystems 21. Power supply subsystems 21 are electrically coupled to drilling drive systems 11 and fracturing drive system 13 to supply power thereto. Each power supply subsystem 21 corresponds to one drilling drive system 11. When some of drilling drive systems 11 are drilling and the other drilling drive systems 11 not drilling, power supply subsystems 21 corresponding to drilling drive systems 11 in operation will supply power to the corresponding drilling drive systems lit when the distributed power supply systems are at peak load. Other power supply subsystems 21 corresponding to drilling drive systems 11 not in operation are employed in the centralized power supply system to supply power to drilling drive systems 11 in operation. When the fracturing drive system 13 is in operation, power supply subsystems 21 are employed together in the centralized power supply system to supply power to said fracturing drive system 13. For example, if simultaneous extraction is only conducted on some of the oil wells of a small oil field, this exploration drilling system 200 can sufficiently utilize the power supply system. Power supply subsystems 21 may comprise one or more gas turbine generators or other power generation equipment. Power supply subsystems 21 are directly electrically coupled to the corresponding drilling drive systems 11 and electrically coupled to the transmission bus or grid 19. Fracturing drive system 13 is electrically coupled to power supply subsystems 21 via said transmission bus or grid 19.

Figure 3:
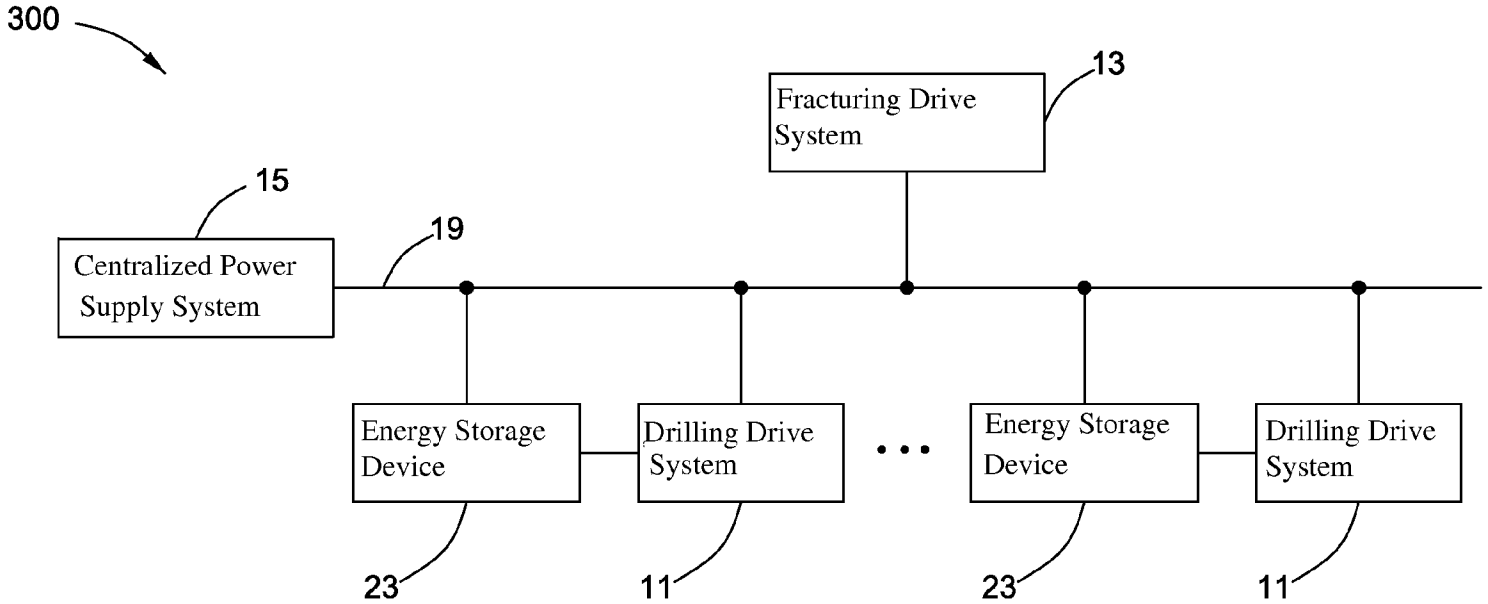
FIG. 3 is a schematic diagram of yet another embodiment of the drilling system of the present invention.

FIG. 3 is a schematic diagram of exploration drilling system 300 of yet another embodiment. Exploration drilling system 300 is similar to exploration drilling system 100 shown in FIG. 1. In contrast to exploration drilling system 100 shown in FIG. 1, exploration drilling system 300 comprises one or more energy storage devices 23 coupled to centralized power supply system 15 to store power from centralized power supply system 15 and provide additional power to drilling drive systems 11 when at peak load. Energy storage devices 23 act as distributed power supply systems to supply power to said drilling drive systems 11. Energy storage devices 23 are electrically coupled to the transmission bus or grid 19. During fracturing, centralized power supply system 15 transmits power to fracturing drive system 13 and charges energy storage devices 23. A plurality of energy storage devices 23 are separately coupled to corresponding drilling drive systems 11, and drilling drive systems 11 are electrically coupled to the transmission bus or grid 19. Centralized power supply system 15 supplies basic power drilling drive systems 11 via transmission bus or grid 19 during drilling of wells. When one or more drilling drive systems are suddenly at peak load, energy storage devices 23 will discharge to supply additional power to drilling drive systems 11. Energy storage devices 23 can be supercapacitors, etc.

Figure 4:
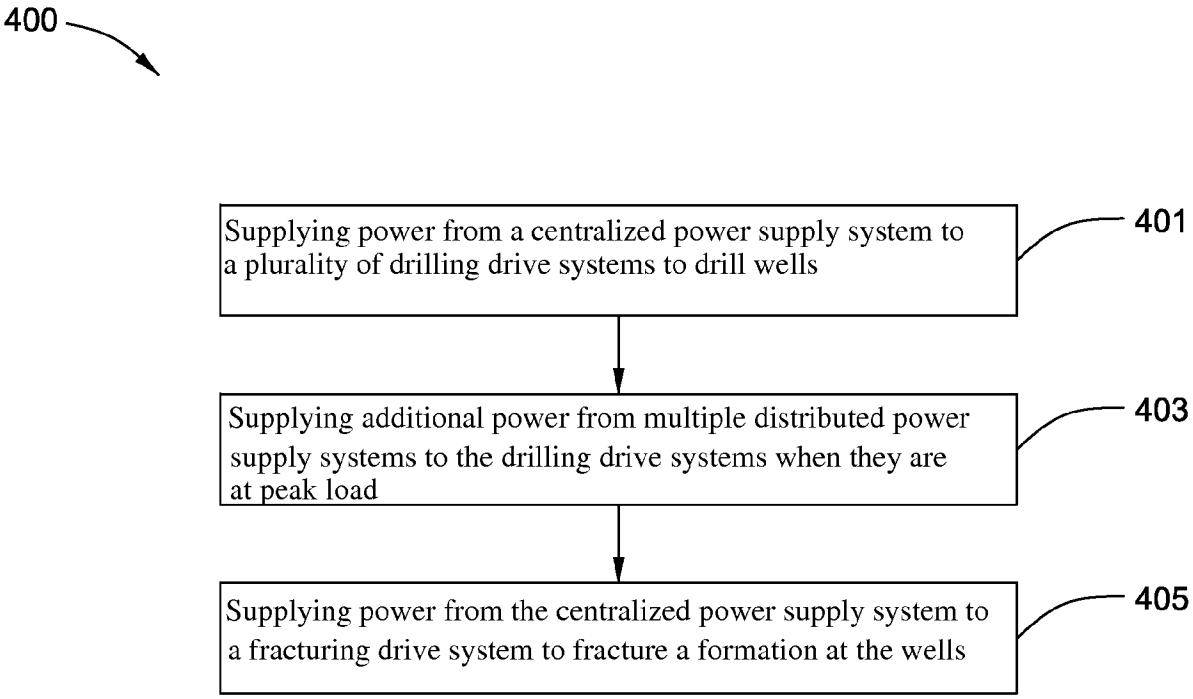
FIG. 4 is a flow chart of one embodiment for the method of supplying power to the drilling system of the present invention.

FIG. 4 shows a flow chart of one embodiment of method for supplying power to exploration drilling system 400. In step 401, power is supplied from a centralized power supply system to a plurality of drilling drive systems to drill wells. The centralized power supply system continuously supplies electrical energy at a stable high power to the drilling drive systems and the plurality of drilling drive systems can drill wells simultaneously. The centralized power supply system comprises a plurality of diesel engines, an aero-derivative turbine or other power generation equipment. In step 403, additional power is supplied from multiple distributed power supply systems to the drilling drive systems when they are at peak load. Each distributed power supply system corresponds to one drilling drive system and supplies power to such drilling drive system. When a drilling drive system is suddenly at peak load due to factors such as geology, the distributed power supply systems supply low-power electrical energy to the drilling drive systems to bear the sudden load increase. At such time, the centralized and distributed power supply systems supply power simultaneously. In one embodiment, the distributed power supply system comprises one or more gas turbine generators.

In another embodiment, the distributed power supply system comprises one or more energy storage devices, such as supercapacitors. The energy storage devices are coupled to the centralized power supply system. Power supply method 400 further comprises employing energy storage devices to store power from said centralized power supply system and providing additional power to the drilling drive systems when at peak load by means of the energy storage devices.

In yet another embodiment, the power supply device, such as gas turbine generator, is electrically coupled to the corresponding drilling drive system thereof. When some of the drilling drive systems are not in operation, the corresponding power supply device thereof can act as the centralized power supply system to supply stable power to the other drilling drive systems in operation. The power supply devices corresponding to the drilling drive systems in operation are employed as distributed power supply systems to supply power to the drilling drive systems at peak load. The power supply devices can be flexibly employed as centralized power supply systems or distributed power supply systems and this embodiment is particularly suited to the exploitation of small oil & gas fields.

In step 405, power is supplied from the centralized power supply system to the fracturing drive system to fracture a formation at the wells. The centralized power supply system supplies stable high-power electricity to the fracturing drive system to fracture.

Step 403 of the supply of power from the distributed power supply system is performed in the process of step 401 of the supply of power from the centralized power supply system to drilling drive systems. The centralized power supply system continuously supplies power during well drilling, while the distributed power supply systems supply power at peak load during the supply of power from the centralized power supply system. Fracturing can be conducted in old wells that are already drilled based on the actual state of extraction, and then new wells can be drilled. The sequence of step 401 for the supply of power from the centralized power supply system to drilling drive systems and step 405 for the supply of power from the centralized power supply system to fracturing drive systems is not limited to that disclosed in the drawings and can be determined based on actual extraction conditions.

Although the present invention is described with reference to specific modes of implementation, a person skilled in the art should be aware that many modifications and variations may be made to the present invention. Consequently it should be noted that the intention of the claims covers all modifications and variations falling under the true spirit and scope of the present invention.

What is claimed is:

1. An exploration drilling system, comprising:

a plurality of drilling drive systems;

a fracturing drive system;

a centralized power supply system electrically coupled to said plurality of drilling drive systems and to said fracturing drive system to supply power thereto; and a plurality of distributed power supply systems, with each drilling drive system of the plurality of drilling drive systems electrically coupled to only one distributed power supply system of the plurality of distributed power supply systems to supply additional power from a respective one distributed power supply system to a respective one drilling drive system during peak loading of the respective one drilling drive system of the plurality of drilling drive systems.

2. The system of claim 1, wherein the centralized power supply system comprises a plurality of diesel engines.

3. The system of claim 1, wherein the centralized power supply system comprises an aero-derivative gas turbine.

4. The system of claim 1, wherein the plurality of distributed power supply systems comprises one or more gas engines.

5. The system of claim 1, wherein the plurality of distributed power supply systems comprise one or more energy storage systems coupled to the centralized power supply system to store power therefrom and later supply the additional power to the plurality of drilling drive systems during the peak loading.

6. A method, comprising:

supplying power from a centralized power supply system to a plurality of drilling drive systems, and to a fracturing drive system to fracture a formation at a well;

electrically connecting to each drilling drive system of the plurality of drilling drive systems only one distributed power supply system of a plurality of distributed power supply systems; and supplying additional power to a respective one drilling drive system of the plurality of drilling drive systems from a respective one distributed power supply system of the plurality of distributed power supply systems during peak loading of the respective one drilling drive system of the plurality of drilling drive systems.

7. The method of claim 6, wherein the centralized power supply system comprises a plurality of diesel engines.

8. The method of claim 6, wherein the centralized power supply system comprises an aero-derivative turbine.

9. The method of claim 6, wherein the plurality of distributed power supply systems comprises one or more gas engines.

10. The method of claim 6, wherein the plurality of distributed power supply systems comprise one or more energy storage systems coupled to the centralized power supply system and the method further comprises storing power in the one or more energy storage systems from the centralized power supply system and later supplying the additional power from the one or more energy storage systems to the plurality of drilling drive systems during the peak loading.

* * * * *